US005214618A

United States Patent [19]

Bugiel

[11] Patent Number: 5,214,618

[45] Date of Patent: May 25, 1993

[54] METHOD AND ARRANGEMENT FOR COMBATING A SUBMERGED TARGET OBJECT

[75] Inventor: Georg Bugiel, Bonn, Fed. Rep. of Germany

[73] Assignee: Diehl GmbH & Co., Nurnberg, Fed. Rep. of Germany

[21] Appl. No.: 907,152

[22] Filed: Jul. 1, 1992

[30] Foreign Application Priority Data

Jul. 11, 1991 [DE] Fed. Rep. of Germany ..... 4122892

[51] Int. Cl.[5] ..... H04B 11/00

[52] U.S. Cl. ..... 367/131; 367/120; 367/136

[58] Field of Search ..... 367/96, 99, 118, 131, 367/104, 120, 136; 114/316, 317, 318, 319, 320, 22, 21.3, 23

[56] References Cited

U.S. PATENT DOCUMENTS 3,811,379 5/1974 Sondheimer ..... 367/131
4,079,687 3/1978 Mentcher ..... 367/131

FOREIGN PATENT DOCUMENTS 1347462 2/1974 United Kingdom .

*Primary Examiner*—Daniel T. Pihulic
*Attorney, Agent, or Firm*—Scully, Scott, Murphy & Presser

[57] ABSTRACT

A method for combating a submerged target object through the intermediary of an active body which is deployable in an airborne mode, and which picks up a sonar contact with the target object from a helically descending searching trajectory below the water level. Also disclosed is an arrangement for combating a submerged target object, especially a double-hulled submarine, through the intermediary of an active body deployable in an airborne mode which is equipped with a sonar installation and with guidance media for the traversing of a helical gliding search trajectory. Upon contacting a target through the intermediary of a searching sonar which is more simply constructed in comparison with a homing sonar, the active body launches an effector which is equipped with an extremely rapid drive into linear attacking trajectory tangentially to the searching trajectory, and wherein the effector will detonate a warhead upon impact against a target.

13 Claims, 4 Drawing Sheets

METHOD AND ARRANGEMENT FOR COMBATING A SUBMERGED TARGET OBJECT

BACKGROUND OF THE INVENTION

1. Field of the Invention

The present invention relates to a method for combating a submerged target object through the intermediary of an active body which is deployable in an airborne mode, and which picks up a sonar contact with the target object from a helically descending searching trajectory below the water level. Moreover, the invention is directed to the provision of an arrangement for combating a submerged target object, especially a double-hulled submarine, through the intermediary of an active body deployable in an airborne mode which is equipped with a sonar installation and with guidance media for the traversing of a helical gliding search trajectory.

2. Discussion of the Prior Art

The measures of the type which are under consideration herein are generally known from the disclosure of British Patent 1,347,462, in accordance with which a torpedo is deflected from a searching-sinking phase into a spiral trajectory upon making contact with a target with the switching of the sonar installation from searching operation to a target tracking operation so as to home onto the target at a renewed contact with the target by means of the currently employed tracking guidance system.

The necessity for the provision of apparatus (from the standpoint of position-finding or bearing technology, propulsion technology and ammunition technology) for being able to implement a potentially successful torpedo attack against mines or submerged vessels, such as submarines, is in all instances extraordinarily high. Thus, for searching for a target and the tracking of a target it is necessary to provide for a mechanically or electrically pivotable sonar base possessing relatively large dimensions for obtaining the necessary solution or analysis, which requires a large torpedo diameter and resultingly considerably high propulsive power; whereas on the other hand; however, due to the large torpedo volume and the high propulsive power, this has as the result of causing high degree of probability of discovery or betrayal in addition to self-endangerment through the sonar-searching operation. In order that its own operation does not disturb the search-and-tracking sonar, it must be more frequently switched off for enabling a measuring-listening travel, which brings along a demand on control or guidance technology for the stabilization of the position of the torpedo in the water and an expenditure of time during the tracking of a target object. Moreover, the distance which must be traversed by an ordinary torpedo to the target object is limited, when it relates to a rapidly moving submersible, such as a submarine, whose speed must be substantially surpassed by that of the tracking or chasing torpedo, when the target object which has set itself in a timely manner into a fleeing movement could possibly still be reached. However, at a high traveling speed for the torpedo, on the other hand, there are again encountered restrictions with respect to its maneuverability, which is disadvantageous, in order to be able to swing from a drag curve which is unsatisfactory for the attack into an optimized advanced trajectory relative to the extrapolated target movement. Finally, by means of the ordinary torpedo, there must be transported extraordinarily large quantities of explosives into the closest possible proximity to the target object, inasmuch as the effectiveness from the standpoint of the ammunition technology is not predicated on a hit (comparable to a projectile), but on the initiation of water or hydraulic pressure waves for the transmission of such intense water or hydraulic pressure pulses, that the operational capability of the target object is disrupted thereby to at least to some lasting extent. On the other hand, the payload space for a warhead is restricted by the large volume which is required for the heavy electrical energy storage required for the electro-motorized torpedo propulsion system.

SUMMARY OF THE INVENTION

In recognition of these conditions, it is accordingly an object of the present invention to improve upon the measures as described hereinabove to such an extent as to be able to obtain an effective combating of a target located below water with a smaller, and to that extent also a less expensive and additionally, logically, a less complex projectile possessing a reduced inherent probability of discovery or betrayal and thereby a higher hitting effectiveness.

The foregoing object is inventively achieved in that the inventive measures are attained whereby the active body glides along the searching trajectory without any own propulsion device to glide along the searching possessing its own propulsive drive, and upon contacting a target through the intermediary of a searching sonar which is more simply constructed in comparison with a homing sonar, launches an effector which is equipped with an extremely rapid drive into linear attacking trajectory tangentially to the searching trajectory, and wherein the effector will detonate a warhead upon impact against a target.

Additionally, the foregoing object is also achieved through the provision of an arrangement of the type as described herein, in that the active body is an unpowered or propulsionless underwater glider, which is equipped with a target searching sonar which is much simpler in construction compared with a target-tracking sonar installation, and is designed as a carrier for an effector which is launchable therefrom, the latter of which is equipped with a high-speed underwater propulsion mechanism for traversing the distance between the launch from the glider in a direction tangentially to the gliding searching trajectory to the target object along an essentially linear attacking trajectory which is specified by the target-searching sonar.

In accordance with the foregoing object, it is not necessary to provide for the large expenditure of explosives for the initiation of an adequate water-hammering effect in the target object inasmuch as the target object is attacked in a direct shot, such that a small quantity of explosives behind a suitable cladding will be adequate to not only rupture the external tanks but; for example, also rupture the pressure hull of a submarine. Implemented hereby is the firing of the herein so-called effector from a glider, which in the absence of a propulsion device and thusly at a low probability of discovery or betrayal, and a low sonar interference, as well as with savings of propulsion energy which commencing from a circular trajectory by means of an inclined forwardly fixedly oriented; effectively, from the standpoint of apparatus a simple searching sonar, responds to a coaxially forwardly detected target object, and starts the high-speed drive system, preferably a rocket-reaction drive of the effector. The latter then traverses extremely rapidly; In essence, not target-tracking but in a direct fire-line of sight, the distance to the target object, which in view of this surprisingly rapid approach has practically no chance of any defense or taking flight. Thus, it does not pertain to a torpedo-typical homing-defense method, but to a system attacking in direct fire or shot with a reusable propulsionless firing base in which there are arranged the essential components of the sonar intelligence system.

Should the target object be missed by the direct firing trajectory, inasmuch as the target object, for example, was in the interim able to evade in a sideways direction, then after the passage of a reference-travel time determined by the searching sonar prior to the launch of the effector, the movement of the effector is changed over into a spirally descending approach or hitting trajectory from which, with a high degree of probability, there is again carried out in an effectiveness-optimized mode, a hit in the side of the target object. Accordingly, for this purpose, it is not necessary to provide any auxiliary sensor equipment on board the effector, inasmuch as the target-detecting sonar of the glider, from which the effector is launched, delivers a somewhat rough but sufficiently precise distance to the target, so as to supply to the effector at its firing, a reference-time information for the eventual commencement of the horizontal trajectory deviation.

For the case, instance, in which the target object is not intended to be struck by the effector in either a direct short or from the deviated descending trajectory, the effector guidance can be so designed that in the normal instance there is effected an over-travel beyond the target object. Hereby, the effector is then additionally equipped with a simple proximity sensor which is oriented forward downwardly angled, which, in effect, does not coaxially forwardly emit any significant radiation tending to influence the probability of discovery, and due to its simple distance measuring-function will not be significantly disrupted by the inherent traveling noise produced by the effector itself. When this proximity sensor determines the over-travel above the target object, there is then carried out a conversion from the previous linear attacking trajectory into a steep falling or diving trajectory from above onto the target object.

In order to still be able to swing immediately prior to striking the target into a expedient; namely, right-angled position for the effectiveness of its warhead, there can be provided on the effector a forwardly oriented mechanical guidance or steering device; for example, in the shape of spreader legs which are telescopable by means of stored spring force or contact initiated gas generators, which at an inclined approach to the target object, will impart a torque to the effector through suitable supporting moments into a perpendicular or normal orientation relative to the impact surface on the target. As a result thereof, the penetrating effectiveness of the effector or; in essence, of its warhead, is more expediently positioned and thusly optimized.

BRIEF DESCRIPTION OF THE DRAWINGS

Additional alternatives and modifications, as well as further features and advantages of the invention may now be more readily ascertained from the following detailed description of an exemplary embodiment as illustrated in the drawings in a generally schematic and abstract manner, taken in conjunction with the accompanying drawings; in which.

DETAILED DESCRIPTION

Figure 1:
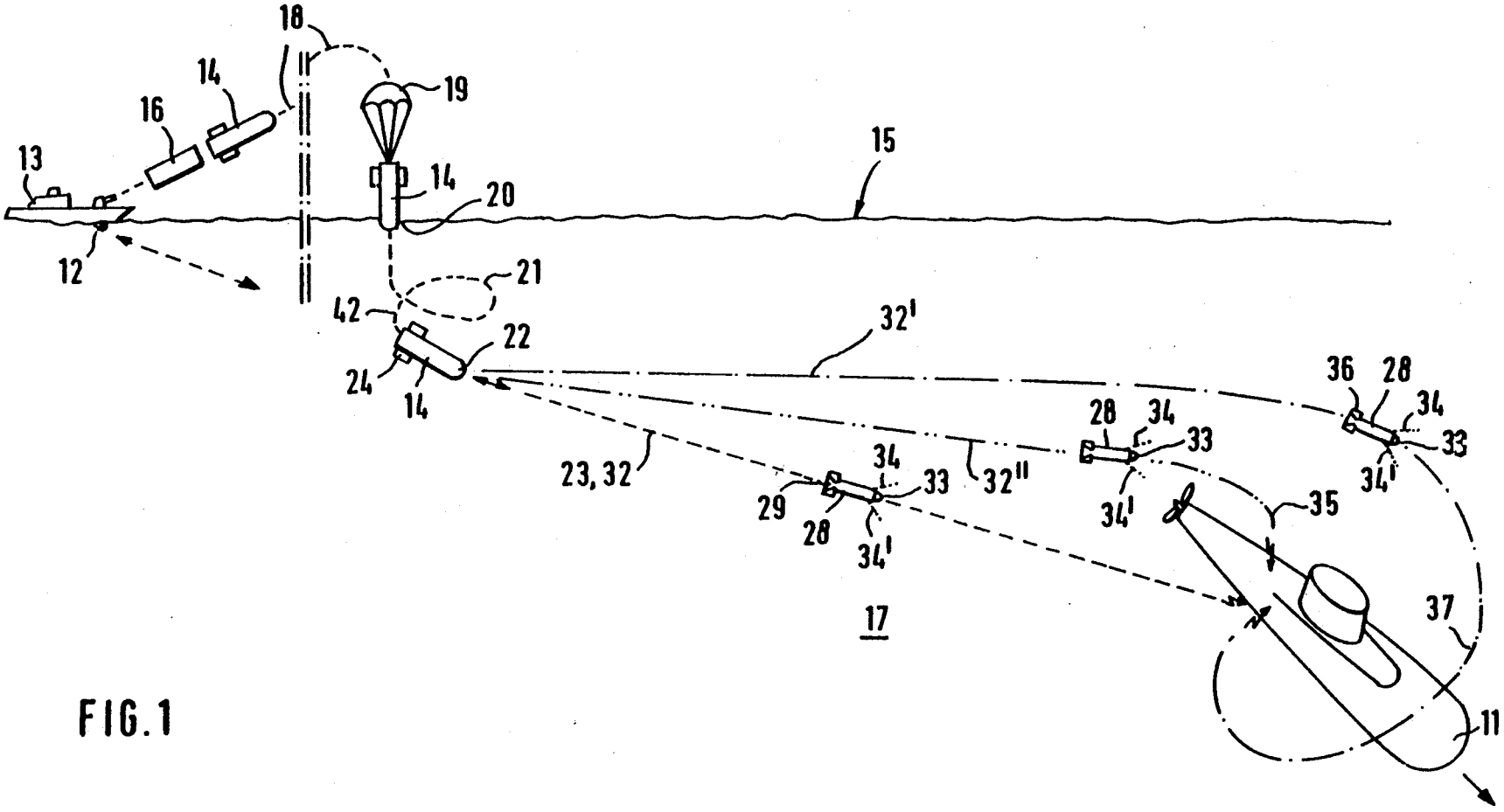
FIG. 1 illustrates a vertical representation of the scenario of attacking a submerged submarine through the intermediary of an airborne-deployed rapid effector which is launched into a searching spiral, which in accordance with the target-encountering situation strikes in a directly fired shot, swings towards the side of the target into a circular descending hitting trajectory or, as required, when over the target undergoes a transition into a steeply falling or diving trajectory.

In the scenario for the combating of a submerged target object in the shape of a submarine 11, as is illustrated in FIG. 1, whose approximate relative location has been determined by means of a sonar installation 12 on a search vehicle 13 (which can pertain to a submarine-hunting, i.e. subchasing helicopter or, as illustrated herein, to a surface vessel), the active body 14 for the combating of the target passes the largest part of the distance to the submarine 11 through the air above the water level 15 in quasi-ballistic flight. For this purpose, the warhead 14, for example, as is known, is launched by means of a rocket propulsion mechanism 16 located, for instance, on board the search vessel 13 (or on board a vessel acting in coordination therewith, which has the target coordinates transmitted thereto from the search vessel 13). After determining the initial launching speed the warhead 14 continues to fly in an inertial manner, after the rocket propulsion mechanism (booster) 16 has been expelled and dropped down.

After entering the region 17 close to the target (which extend in a magnitude of a few hundred meter measured horizontally about the enemy submarine 11) then, in a known manner, there is initiated the steep descent from the ballistic trajectory 18 through activation of braking means 19; for instance, such as a parachute fastened to the tail end of the active body 14. This can be initiated; for example, either program-controlled from the search vessel 13 prior to the launch, or remote-controlled during flight, when the ballistic trajectory 18 has not already been calculated for a specified submersing region 20, in order to eliminate the need for special braking means 19 for leaving the traversing trajectory 18. Basically, the active body 14 can also be ejected directly in a close area above the target surroundings, such as from an aircraft or the like.

Figure 2:
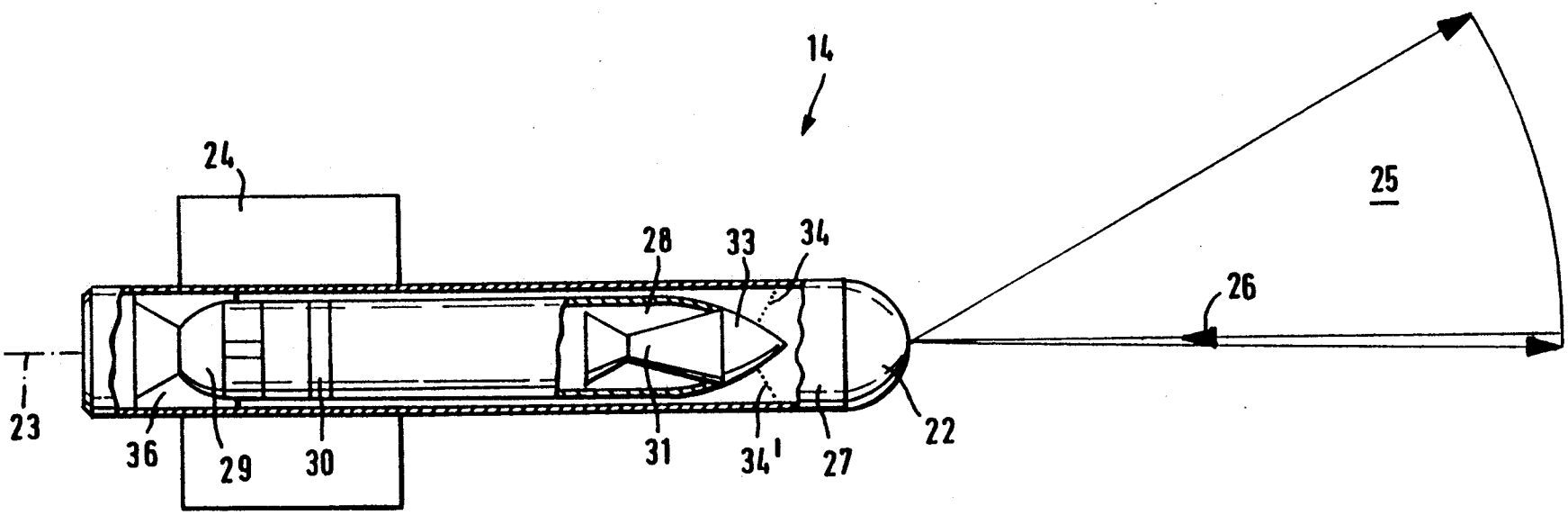
FIG. 2 illustrates on an enlarged scale, in a partially-sectional top plan view, the airborne-deployable active body of an underwater glider with target searching-sonar, and from the latter a propelled effector oriented into the attacking trajectory.

In any event, the warhead 14 passes approximately vertically through the water level 15 into the region 17 close to the target. The entry into the water is detected on board the active body 14 through the changed conditions in the surroundings (another environmental medium and/or retardation encountered during entry into the water) so as to, on the one hand, separate therefrom the braking medium 19 which is generally disturbing during the movement through water (for example, such as a parachute) and, on the other hand, to set flow-dependently acting guidance means, such as control surfaces or adjustable gliding support surfaces, in a manner that in the region of immersion 20, there takes place already as closely as possible below the water level 15, a deflection of the approximately vertical entry into a propulsionless movement along a helically descending gliding search path 21. Moreover, as shown in FIG. 2, there is activated an eccentrically forwardly oriented target-searching sonar 22 on a glider 27 for the active body. With respect to the foregoing, this can pertain to an extremely simple installation from the standpoint of apparatus in comparison with the sonar installation of a homing torpedo; in particular, inasmuch as it is not necessary to implement any mechanical or electrical oscillation of the search-characteristics system and no connection from the standpoint of signal technology with a follow-up guidance device for the underwater course of travel. Thereby, notwithstanding the equipping with a relatively inexpensive target-searching sonar 22, it is also possible, inasmuch as the gliding searching trajectory 21 is traversed by the active body 14 without the use of any propulsive device, by itself due to the reduction in the kinetic and potential energy, that no bearing or position-finding interferences are encountered which could be caused by the noise spectrum from its own propulsion aggregate. A further reduction in the cost of this target searching sonar 22 can be realized in that the submarine 11 which is positively to be attacked has already been acquired by means of the essentially more extensively equipped sonar installation 12 of the search vessel 13 so that characteristics which are specific to the target can be transmitted to the small target-searching sonar 22 and herein, as a result, the demands on signal processing technology for the target detection can be reduced to a further extent.

Implemented expediently below the immersing area 20 is the conversion into the helical gliding search trajectory 21 in such a manner that the search-and-motion axis 23 initially subtends an acute angle during at least one revolution relative to the water level 15, so as to be able to acquire target objects standing relative closely below the water level 15, also only at snorkeling depth, at a still greater distance, in effect, not to search about therebelow. There is then carried out, either in a time-controlled mode or derived from the positional change in space of the active body 14, a reorientation of the guidance medium 24 (supporting surfaces and/or control rudder) for a shallow descending gliding search trajectory 21 for the scanning of the close region 17 in the surroundings about the immersing area 20 along generally spiral target-like successive sectors. For the most possibly gapless scanning of the surroundings it can be advantageous to orient the gliding search trajectory 21 as closely as possible to the horizontal and each time, after one revolution or spiral of travel, into a descent so as to be able to again pick-up kinetic energy for the next (therebelow located) horizontal search trajectory 21. The program control assignment for the radius of the trajectory and the path of the descent are oriented to the geometric target prescriptions in order not to miss this target.

It is somewhat more expedient (as shown in FIG. 2) to deviate the transmitting characteristic 25 of the target-searching sonar 22 of the glider in the direction of the curvilinear travel (curvature of the gliding search trajectory 21) with respect to the receiving characteristics 26 which is coaxial with the axis of motion 23 by a fixed tilt or screw angle. As a result thereof, this will afford that any kind of target object can be already detected by the target-searching sonar 22 prior to the swinging thereinto of the axis 23.

As is illustrated in specific detail in FIG. 2, the active body 14 which is deployable above the water level 15 consists of an undriven or propulsionless glider 27 serving as a carrier and a launching device for an effector 28. The last-mentioned is launched coaxially forwardly from the glider 27 when there is detected forwardly in the receiving-and-motion movement axis 23 by the target-searching sonar 22 of the glider the submarine 11 which is to be attacked. Accelerated by means of a reaction propulsion mechanism 29, and two - point guided from a simple autopilot-inertial guidance 30 for the compensation of any kind of starting and drift disturbances pursuant to the extent of the bearing prescription during launch from the glider 27, the effector 28 "fires" along the launch orientation (and thereby tangentially to the gliding search trajectory 21) linearly forwardly towards the submarine 11. The tandem warhead 31 of the active body 14 is designed, for example, through the axial staggering of a hollow charge and a projectile-forming charge, to initially rupture the flooding chamber-outer hull of the submarine 11 and then thereby with an immediately following explosives-formed projectile rupture the pressure hull of the submarine 11 so that the latter becomes incapable of operating.

Although the effector 28 travels along its attacking trajectory 32 at an extremely high rate of speed along the axis 23, along which there has in front thereof been detected a submarine 11 which is to be attacked, it is not possible to preclude that the target object will not be struck directly along this axis. This is based on the fact that the submarine 11 need not be stationarily positioned, it can move relatively rapidly, and above all pursuant to the localized conditions of sound propagation existing between the search sonar 22 of the glider and the detected submarine 11, there are encountered different bearing deviations during the propagation of the ultrasonic signal, as a result of which (corresponding to the diffraction of a beam of light at an angled radiation into a water surface), there actually exists a geometric deviation between direction towards the reflecting target object and the direction of incidence of the received echo signal. Consequently, there is expediently evaluated or plotted that the search sonar 22 of the glider also delivers an instantaneous information as to the distance to the target object; in essence, with respect to the transmitting-receiving characteristics 25, 26 of the detected submarine 11. Inasmuch as due to the combusting behavior of propulsion mechanism 28 of the effector there is previously known its cruising speed along the linear attacking trajectory 32, a target determination by means of the proximity sensor 33 can no longer be expected from the original attacking trajectory 32' in accordance with a time interval corresponding with a distance which is to be measured commencing from the firing of the effector 28 from the glider 27. The guidance means 36; for example, such as ailerons or flap wings and, possibly, stabilizer fins, must thereby be adjusted, in dependence upon time, namely, at the completion of an expected target-hitting time interval which is actually specified at this firing dependent upon distance, so as to provide a transition from the previous linear attacking trajectory 32 into a spirally descending target-hitting path 37, in order to be able to also attack the submarine 11 when it has moved from its original position in which it had been detected by the search sonar 22 of the glider. The radius and the widening in the spirals of the hitting trajectory are specified with respect to the type of target, such that the submarine 11 will be detected even during its fleeing movement after typically the latest two spiral circles with a high degree of probability.

The deviation from the linear attacking trajectory 32' into the spiral target-hitting trajectory 37 can be effected in a directionally dependent manner as to which side the submarine 11 has offset itself relative to the original attacking trajectory 32'. For this purpose, a proximity sensor 33 in the type of an echo depth finder need only be equipped with a transmitting-receiving characteristic as a sensor 34' which, with a sideways orientation, is oriented angled forwardly and downwardly.

When on board the effector 28 it is permissible to provide for an increase in technological equipment in the interest of obtaining an enhanced hitting effectiveness, then the inertial guidance 30 of the effector 28 which is launched from the glider 27 is expediently (as is considered symbolically simplified in FIG. 1) so set that the actual attacking trajectory 32'' is anticipated to extend above the submerged submarine 11. In order to nevertheless be able to attain a hit; and, namely, a hit under an expedient striking angle against the submarine 11, the proximity sensor 33 is designed for the incorporation of an additional characteristic in the form of at least one sensor or probe 34' which is oriented angled forwardly and downwardly. By means of this sensor or probe, as is illustrated in FIG. 1, there is detected the immediately anticipated travel over the submarine 11, inasmuch as the echo signals from the proximity sensor 33 now suddenly originate from a relatively good reflector at a short distance; in effect, can be simply distinguished from echoes received from the surrounding mass of water; in essence, from the further distanced ground of the water. As soon as the proximity sensor 33 signals the anticipated passage over the submarine 11, the (inertial) guidance 30 switches from the linear travel of the attacking trajectory 32'' to a steep vertically tilting diving trajectory 35 so that the submarine will be struck with the greatest degree of probability under an expedient striking angle in the region of its deck structure.

Figure 3C:
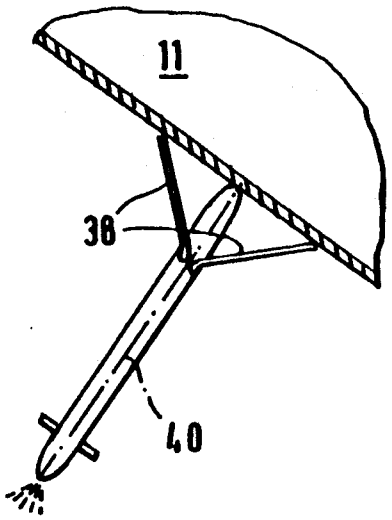
FIGS. 3*a* through *c*, respectively, illustrate in schematic representation the successive phases of movement of the mechanical guidance at a non-perpendicular striking of the effector against the target object.
Figure 3B:
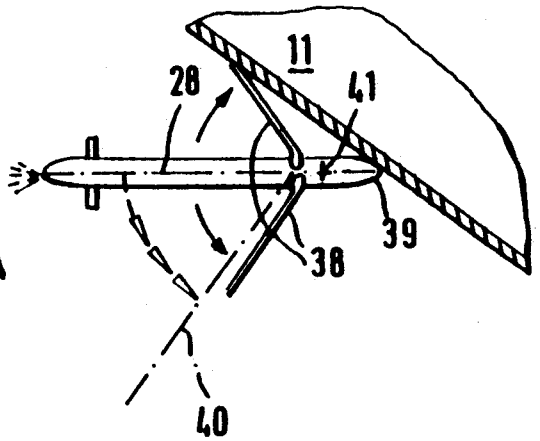
Figure 3A:
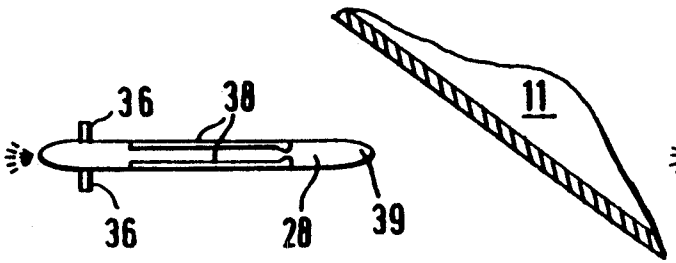

In the event of an inexpedient striking angle for the effector 28; for example, against a curved portion of the submarine 11, under circumstances it cannot be precluded that the projectile of the warhead 31 will only tangentially strike the wall of pressure hull of the target object; in effect, will not produce any effect in the pressure hull which could significantly adversely influence its condition of operational readiness. This effect can be basically reduced when the effector 28, immediately prior to striking against the submarine 11, is once again deflected into a normal or perpendicular direction relative to the latter. During the remaining, extremely short residual running time, the demands on providing sensor technology for the controlled guidance is in any event considerable, and with flow-dependently operating guidance means 36 (control rudder in FIG. 2), this necessarily rapid guidance would hardly be able to be implemented. As a result thereof, pursuant to FIGS. 3 or 4, it is more expedient to employ a supporting lever guidance or steering of the type in that, immediately prior to striking against the submarine 11, spreader legs 38 are extended angled forwardly. In view of telescope-like extensions, or due to their linkage kinematics, they can thereafter project forwardly of the tip 39 of the effector. As is ascertainable from FIG. 3*b*; for instance, at least one of these extendable or spreader legs 38 in front of the tip 39 of the effector contact against the outer surface of the submarine 11. In any case, the eccentric support for the approaching effector 28 causes its tilting into practically vertical striking orientation 40 (FIG. 3*c*). For the extension and latching of the spreader legs 38 in their effective operative position (as required, also for extension of telescopable parts) there can be utilized energy accumulators, for instance pursuant to FIG. 4, such as prestressed springs; however, still better are electrically-activatable pyrotechnic power elements, such as are generally known for the extension of swing wings or pivotable control surface employed in the technology relating to guided ammunition. As shown in FIG. 3*a*, during the rapid driven travel of the effector 28 along the outer hull (under circumstances, with a retracted telescopic component), retracted spreader legs 38 are expediently released for extension thereof in dependence upon the traveling time along the attacking trajectory 32, when for this activation there is not contemplated the provision of an additional coaxially forwardly oriented impact or proximity sensor.

The kinematics of the transition into the hitting or striking direction 40 can be influenced by means of the supporting moments; in effect, through the direction and magnitude of the offset of the articulation of the spreader legs 38 relative to the flow-dynamic center of gravity 41 of the effector 28.

Figure 4:
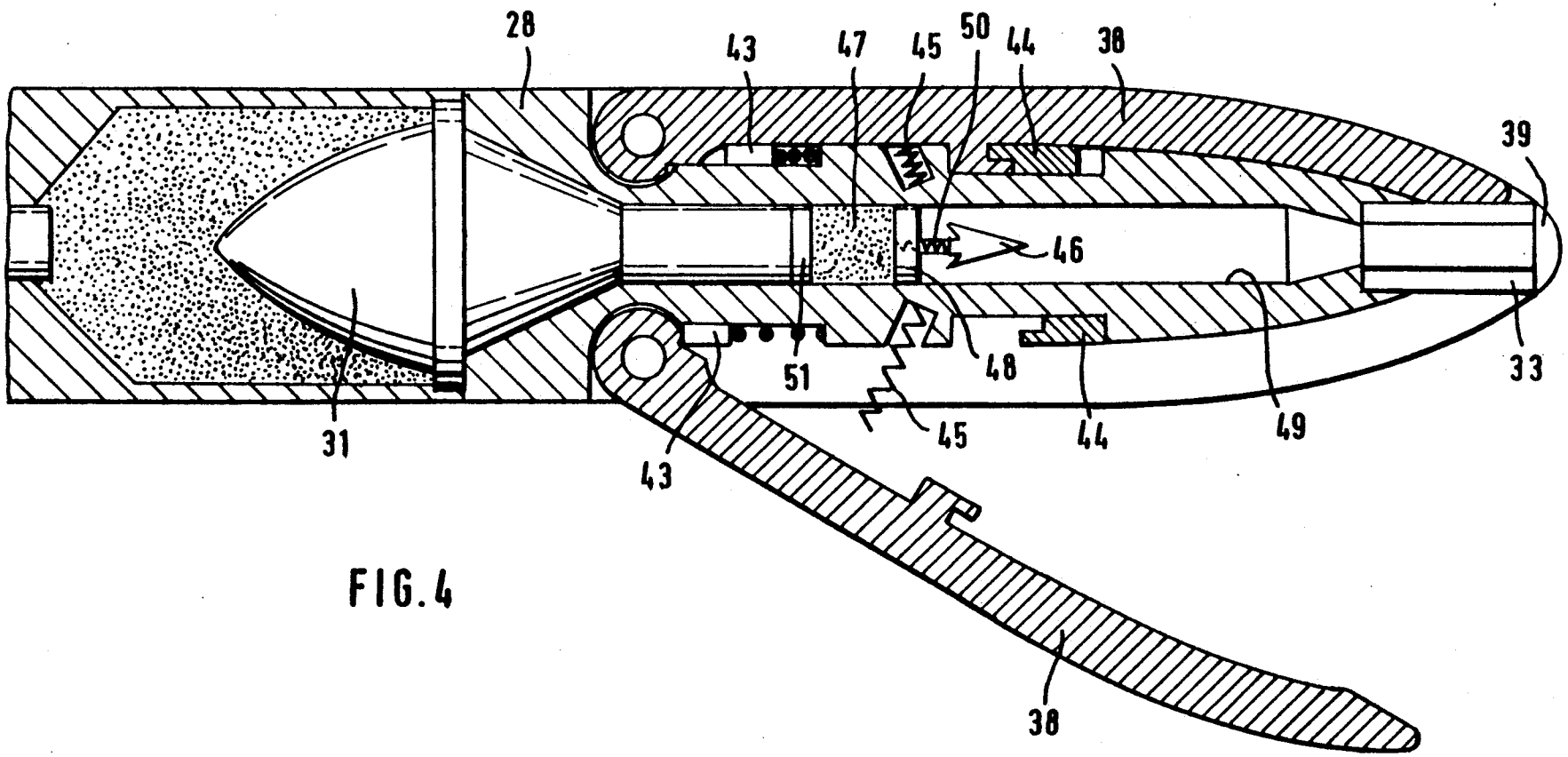
FIG. 4 illustrates, on a further enlarged scale, an anchoring mechanism utilized to prevent a sliding off of the tip of the effector during the deflecting phase shown in FIGS. 3*a* through *c*.

In the effector 28, as is illustrated in FIG. 4 in a partial longitudinal sectional representation, in contrast with the condition pursuant to FIG. 3, the spreader legs 38 in the deploying position are articulated in forwardly folded contacting manner. As a result thereof, there are not extendable to such a length, but these variants evidence the advantage that the spreader legs 38 which are released from the deploying position through the effect of the oncoming or incident water flow are rapidly expanded until they are fixed in their spread-apart position through the latching engagement of a spring-loaded arresting element 43. The latching device 44 for the previously assumed deploying position can be released in an inertial-dependent manner through the impact against the target object or, more dependently, through a small proximity sensor 33, whereupon a transversely acting expanding spring 45 will extend each respective spreader leg 38 from its deploying position within the contour of the effector 28 to such an extent, that the extending force of the incident water flow can become effective.

In order to prevent the tip 39 of the effector, after an acutely-angled impact against the outer surface of the target object which consists of a mild ductile steel or a polyethylene coating, during the pivoting about of the effector 28 into the optimized striking direction 40, from gliding off the submarine 11, in accordance with the possibility which is additionally considered in FIG. 4, provision can be made that approximately simultaneously with the release of the spreader legs 38 there is activated an anchoring arrangement 46. In the illustrated exemplary embodiment, this is symbolized by barbed hooks which, by means of a propellent charge 47, can be accelerated through a piston 48 located in a tubular guide 49, which can pertain to the cylindrical open standoff space in front of the warhead 31 for the formation of a hollow charge barb. In the narrowing front region of the tubular guide 49, the piston 48 is braked down and retained in place, whereas the anchoring arrangement 46, responsive to inertia, will lift away from the piston 48 and exits through the tip 39 of the effector in order to penetrate into the outer hull of the target object. This anchoring arrangement 46 is expediently constructed as a miniaturized projectile possessing a geometry which is full-cavitating in water and including an impact detonator. As a mechanical coupling between the forwardly-fired anchoring arrangement 46 and the effector 28, there can be provided; for instance, a cable-like connection 50. In consequence, there is assured that the tip 39 of the effector, during the pivoting movement (refer to FIG. 3*b*), will not displace itself significantly sideways and as a result, to be able to slide off from the target object. When after pivoting or swinging into the optimized striking direction 40, there is detonated the warhead 31, then the damming or cushioning 51 present behind the space for the propellent charge 47, as well as the forwardly traveled piston 48 are pierced through by the hollow charge barb without any problem, so as to further rip open the anchoring location in the target object, prior to detonating of the projectile-forming main charge for damaging the pressure hull of the submarine 11.

What is claimed is:

1. A method for combating a submerged target object through the intermediary of an airborne-deployable active body comprising a glider, which assumes a sonar contact with the target object from a search trajectory helically descending below water level, said active body gliding unpropelled along the search trajectory and upon contact with the target object by a searching sonar, launches an effector equipped with a drive into a linear attacking trajectory tangentially to said searching trajectory, and said effector triggering a warhead upon striking against the target object.

2. A method as claimed in claim 1, wherein at the completion of a waiting time interval imparted to a guidance for the effector guidance upon said effector being launched from the glider is deviated from the linear attacking trajectory into a spirally descending hitting trajectory for the movement of the effector.

3. A method as claimed in claim 1, wherein the linear attacking trajectory is tangentially oriented above the target object detected by said searching sonar; and sensing on board the driven effector, which is not in a target-seeking mode, the travel of said effector above the target object so as to cause a transition into a steep diving trajectory towards the target object.

4. A method as claimed in claim 1, wherein the glider is initially guided into a gliding searching trajectory after a generally vertically entry into the water level initially into a gliding search trajectory which is oriented to define an acute angle measured from below relative to the water level.

5. A method as claimed in claim 4, wherein the gliding searching trajectory is essentially horizontally oriented and upon completion of about one loop for the pick-up of kinetic energy by the glider deviating into a descent of specified height prior to said glider assuming the next lower gliding search trajectory.

6. Arrangement for combating a submerged target object, said arrangement comprising an airborne-deployable active body equipped with sonar means and with guidance means for traveling along a helical gliding search trajectory, said active body comprising a propulsionless underwater glider including a target-searching sonar, said glider being a carrier for an effector launchable therefrom, said effector including underwater propulsion means for traveling the distance from launch from the glider tangentially to the gliding search trajectory to the target object along an essentially linear attacking trajectory which is specified by said target searching sonar.

7. An arrangement as claimed in claim 6 wherein said effector is equipped with a tandem warhead consisting of a hollow charge located in front of a projectile-forming charge.

8. An arrangement as claimed in claim 6, wherein said effector is equipped with guidance means for deviating the path of travel of said effector from an essentially linear attacking trajectory into a spirally descending target-hitting trajectory, said guidance means being responsive to implement said deviation upon the termination of an expected hitting time interval without contact with a target object as specified at the launch of the effector from the glider.

9. An arrangement as claimed in claim 8, wherein the direction of the deviation of the path of travel of the effector into the target-hitting trajectory is specified by downwardly sideways oriented proximity sensors arranged on board the effector.

10. An arrangement as claimed in claim 6, wherein said effector is equipped with at least one proximity sensor oriented downwardly angled, which comprises a sonic depth finder for effectuating the deviation of an essentially linear attacking trajectory into a steep diving trajectory above the target object.

11. An arrangement as claimed in claim 6, wherein said effector comprises guidance means for deviating the motion thereof immediately prior to or upon striking the target object into a generally right-angled direction of impact.

12. An arrangement as claimed in claim 11, wherein said effector is equipped with forwardly angled spreadable and telescopically extendable spreader legs for imparting a torsional guidance into an optimized direction of impact with the target object.

13. An arrangement as claimed in claim 6, wherein said effector comprises anchoring means operative upon striking a target object.

* * * * *